US006705799B2

(12) United States Patent
Piccoli

(10) Patent No.: US 6,705,799 B2
(45) Date of Patent: Mar. 16, 2004

(54) HYDRAULIC POWERED SCREED

(75) Inventor: Mario Piccoli, London (CA)

(73) Assignee: N. Piccoli Construction, London (CA)

( * ) Notice: Subject to any disclaimer, the term of this patent is extended or adjusted under 35 U.S.C. 154(b) by 33 days.

(21) Appl. No.: 10/057,920

(22) Filed: Jan. 29, 2002

(65) Prior Publication Data

US 2002/0102134 A1 Aug. 1, 2002

Related U.S. Application Data

(60) Provisional application No. 60/331,341, filed on Jan. 31, 2001.

(51) Int. Cl.[7] ..... E01C 19/22

(52) U.S. Cl. ..... 404/97; 404/114; 404/118; 224/157

(58) Field of Search ..... 404/114, 118, 404/97; 224/157

(56) References Cited

U.S. PATENT DOCUMENTS

| | | | | | |
|---|---|---|---|---|---|
| 3,067,656 | A | | 12/1962 | Gustafsson | |
| 3,180,625 | A | * | 4/1965 | Wyzenbeek | 366/122 |
| 3,427,939 | A | | 2/1969 | Braff et al. | |
| 4,431,336 | A | | 2/1984 | Nightengale et al. | 404/97 |
| 4,466,757 | A | * | 8/1984 | Allen | 404/114 |
| 4,591,291 | A | * | 5/1986 | Owens | 404/118 |
| 4,641,995 | A | | 2/1987 | Owens | 404/118 |
| 4,702,641 | A | | 10/1987 | Naser et al. | 404/97 |
| 4,798,494 | A | * | 1/1989 | Allen | 404/114 |
| 4,892,437 | A | | 1/1990 | Kraft | 404/97 |
| 5,147,146 | A | | 9/1992 | Harding, Jr. | 404/97 |
| 5,244,305 | A | | 9/1993 | Lindley | 404/97 |
| 5,375,942 | A | | 12/1994 | Lindley et al. | 404/97 |
| 5,829,874 | A | | 11/1998 | Breeding | 366/120 |
| 5,857,803 | A | | 1/1999 | Davis et al. | 404/102 |
| 5,984,571 | A | * | 11/1999 | Owens | 404/97 |
| 6,053,259 | A | * | 4/2000 | Kojima et al. | 173/30 |
| 6,089,787 | A | * | 7/2000 | Allen et al. | 404/118 |
| 6,231,331 | B1 | * | 5/2001 | Lievers | 425/183 |
| 6,296,467 | B1 | * | 10/2001 | Rouillard | 425/182 |
| 6,322,286 | B1 | * | 11/2001 | Rijkers | 404/114 |
| 6,374,569 | B1 | * | 4/2002 | Suckow | 52/749.13 |
| 6,467,560 | B1 | * | 10/2002 | Anderson | 180/181 |

* cited by examiner

*Primary Examiner*—Gary S. Hartmann
(74) *Attorney, Agent, or Firm*—Marks & Clerk

(57) ABSTRACT

This invention relates to a vibrating screed for compacting and smoothing flowable cementitious materials. More specifically, this invention relates to a self-contained hydraulic powered concrete screed. This hydraulic screed consists of a relatively lightweight screed unit having a hydraulic powered vibrator and a portable hydraulic power pack that is mounted on a back pack wearable by the operator. The handle of the screed unit is isolated from the hydraulic vibrator and screed blade by three rubber isolation mounts. The working height of the handle can be adjusted by a turnbuckle assembly at one of the rubber mounts, causing the handle to pivot about the other two the rubber mounts. The hydraulic power pack comprises an internal combustion engine driving a hydraulic pump that provides pressurized hydraulic fluid to the vibrator unit via flexible hoses.

6 Claims, 4 Drawing Sheets

HYDRAULIC POWERED SCREED

This application claims the benefit of U.S. Provisional Application No. 60/331,341 filed Jan. 31, 2001.

BACKGROUND OF THE INVENTION

This invention relates to a vibrating screed used in compacting and smoothing flowable cementitious materials. More particularly, it is concerned with a vibrating screed, which provides for improved workability and ease of use by the operator for applying vibratory compaction and leveling to flowable concrete.

Various tools are already well known in the art. At the most basic level a straight piece of lumber moved back and forth along the top of the side forms provides the leveling action. Various other devices using direct coupled gas powered vibrators as well as electric or pneumatic vibrators have been proposed. Each of these devices has some important disadvantages.

A hand-operated screed requires two laborers and demands heavy physical work. The work is both slow and requires the men to work at a low level, which is extremely hard on the lower back and knees. A hand screed also requires the concrete surface be floated and trowelled afterwards to bring the grout mixture to the surface to ready the surface for final texturing/treatment.

A number of inventions have been presented to impart vibratory force to a portable screed. This accomplishes two actions—it levels the concrete by pushing the excess material in the direction of movement and also vibrates the surface of the concrete, compacting the coarse aggregate and bringing the grout to the surface resulting in a smooth surface ready for final finishing.

Vibratory screeds powered by internal combustion engines have the disadvantage that it is difficult to prevent the vibrations from the rotating eccentric weight from being transferred to both the operator and the power source itself because of the direct mechanical coupling inherent in the design of the unit. The handles and controls can be partially isolated from the vibrations but due to the direct physical presence of the drive shaft it is not possible to isolate the power source from the vibrations. As with any mechanical device, vibrations cause increase wear and accelerated breakdowns both in the power unit engine as well as in the mechanical fastenings and mounting points on the screed handle frame. As well, the rotating eccentric weight imposes heavy loads on the bearings in which it rotates, again causing heavy wear and accelerated failure. As well, the need to have the engine mounted on the back of the screed handle necessarily requires that the operator carries around and uses an awkward, difficult to handle tool that potentially imparts unsafe forces and loads on the operator's back and back muscles. With the prevalence of lower back problems in the construction industry it is imperative that the use of awkward, heavy tools is minimized as much as possible.

Electric powered vibrators have two major problems. Firstly, a source of electric power is required. Either a generator or convenient line source is needed to power the vibrators. The portable screed must have an long power cord to connect to a suitable power source. In many instances the screeds must be used where no permanent power is available, so a portable generator must be used. In a typical sidewalk construction project the length of a day's pour will be 600 linear feet requiring a substantial power cord or the need to move the portable generator numerous times to keep it within a convenient distance from the work area. This cord will run in and around other construction causing inconvenience and potential safety hazards (tripping, damage to finished work, physical damage to the cord itself). As well there is an increased safety hazard inherent in using electrical devices in an environment that requires the operator to be standing in water or wet material especially if the power cord is continually exposed to wear and damage as it snakes through the construction area.

Pneumatic powered vibrators have a major problem as well—they require a high volume source of compressed air provided through stiff rubberized hoses. The size of the necessary compressor makes it difficult to provide a convenient portable compressed air source for continually mobile sidewalk construction. As well, the thickness of the air hoses required to provide sufficient compressed air flow makes it difficult to handle a portable screed in the limited space available for sidewalk construction. The need to have a thick, 2" hose snaking through the construction area causes problems from both a work management and safety point of view.

Accordingly there has developed a need to provide a safe, easy to use means of imparting vibration to the screed that will be both durable and easy to use without negatively impacting the safety of the work place.

SUMMARY OF THE INVENTION

This invention provides a relatively light weight screed unit coupled to a portable hydraulic power pack that is carried on the back of the operator. The entire weight of the power pack unit is confined to a backpack mounted hydraulic power pack (Husqvarna 250PS or equivalent). As the waist belt and shoulder straps carry most of the weight, there is less stress on the back of the operator.

The hydraulic vibrator unit is mounted directly on the screed itself where the weight of the vibrator tends to keep the screed from floating up off the forms on the surface of the concrete. As well, this location allows for much improved isolation of the operator from the vibrations imparted to the screed. The hydraulic oil flow is transferred along relatively thin flexible hoses that do not negatively restrict use of the screed. The unit is totally self contained and the screed is dragged along the sidewalk construction as it is being used so nothing has to be moved separately as work continues. The hoses can be quickly disconnected so the unit can be stored in a relatively small space. The screed handle is mounted on a rotating hinge with a adjustment turnbuckle so that the angle of the handle to the screed can be adjusted to allow for different height operators to use the screed in comfort. Again this reduces the application of any negative stress to the lower back of the operator as he can adjust the screed handle to allow him to work in an erect stance at all times.

Thus, a primary object of the present invention is to provide a safe reliable and easy to handle mobile vibrating screed.

According to the present invention, there is provided a vibrating screed system for compacting and smoothing cementitious materials. It comprises a vibrating screed unit having a hydraulic vibrator means mounted to a frame means, a screed blade mounted to a bottom side of the frame means and a handle means mounted to the frame means by a plurality of vibration damping means and a hydraulic power pack comprising a self contained rotary power source driving a hydraulic pump. The hydraulic power pack is mounted on a back pack wearable by an operator and the hydraulic pump provides pressurized hydraulic fluid to the hydraulic vibrator means via flexible hoses.

The invention also provides a vibrating screed system comprising a vibrating screed unit and a hydraulic power pack. The vibrating screed unit comprises a hydraulic vibrator mounted to a frame, a screed blade mounted to a bottom side of the frame and a handle unit mounted at an angle to the frame by a plurality of vibration damping units. The hydraulic power pack comprises an internal combustion engine driving a hydraulic pump and is mounted on a back pack worn by an operator. The hydraulic pump provides pressurized hydraulic fluid to the hydraulic vibrator via flexible hoses.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
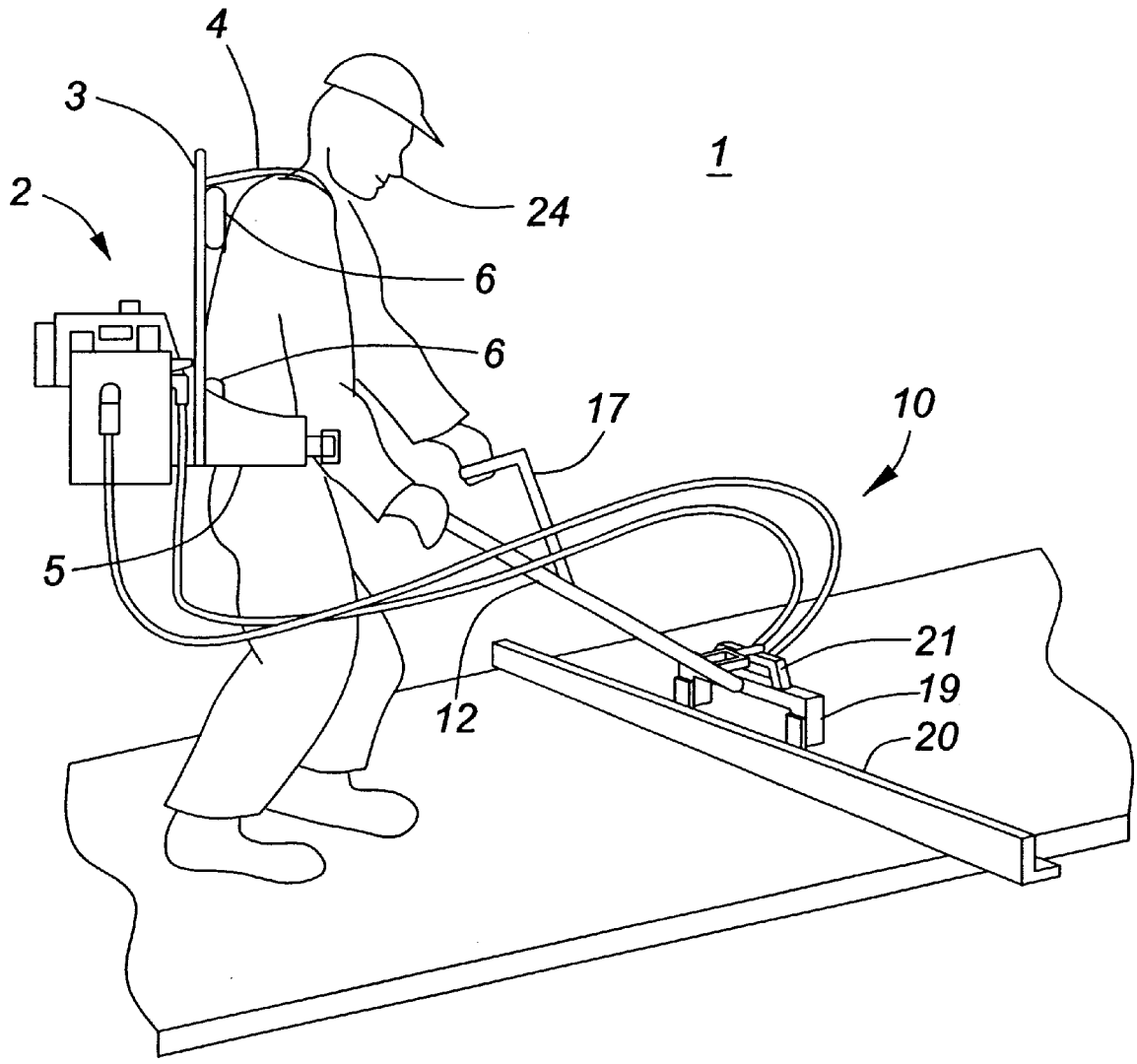
FIG. 1 is a perspective view of the concrete screed in use by an operator.
Figure 2:
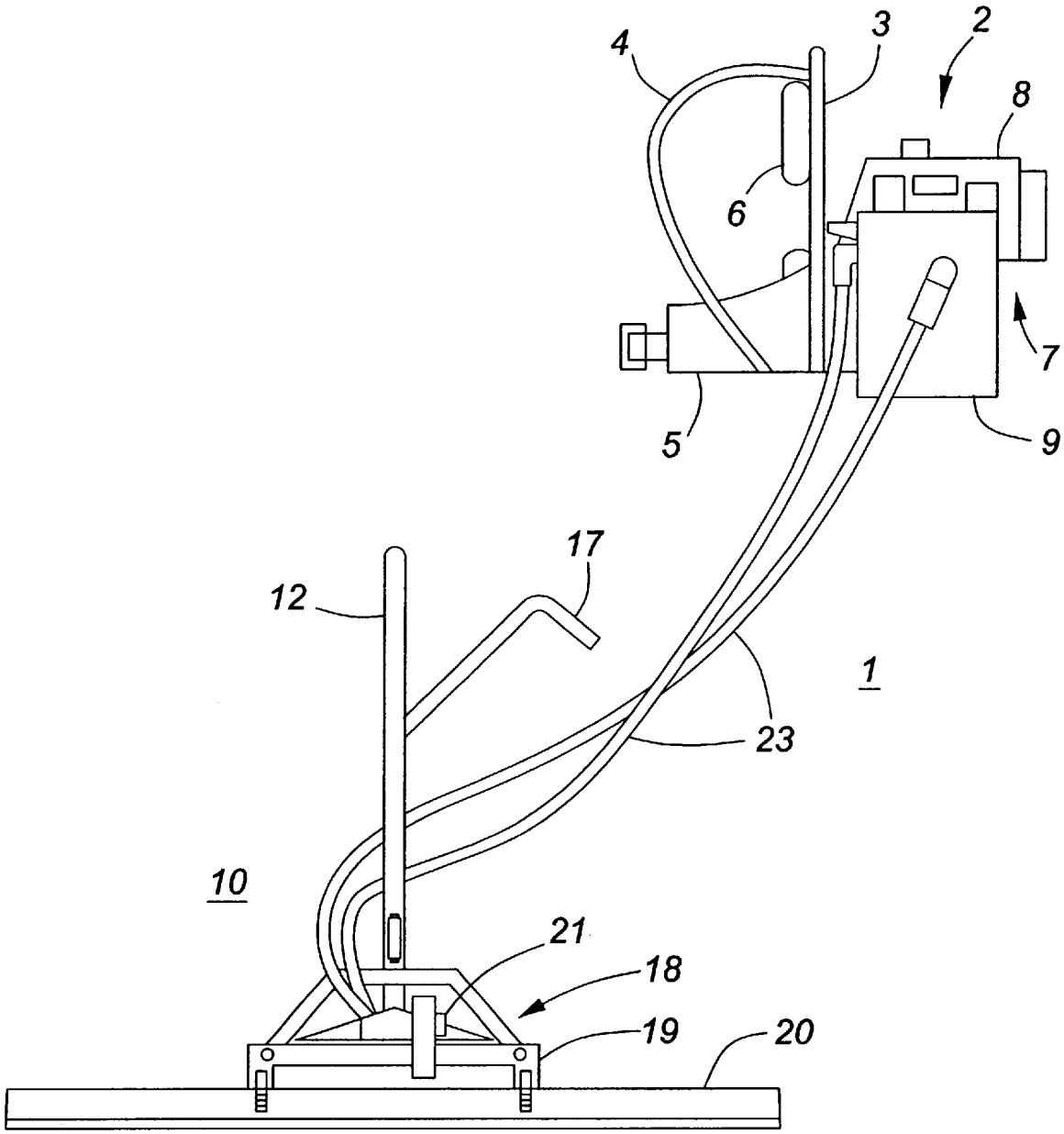
FIG. 2 is a front view of the concrete screed and back pack.
Figure 3:
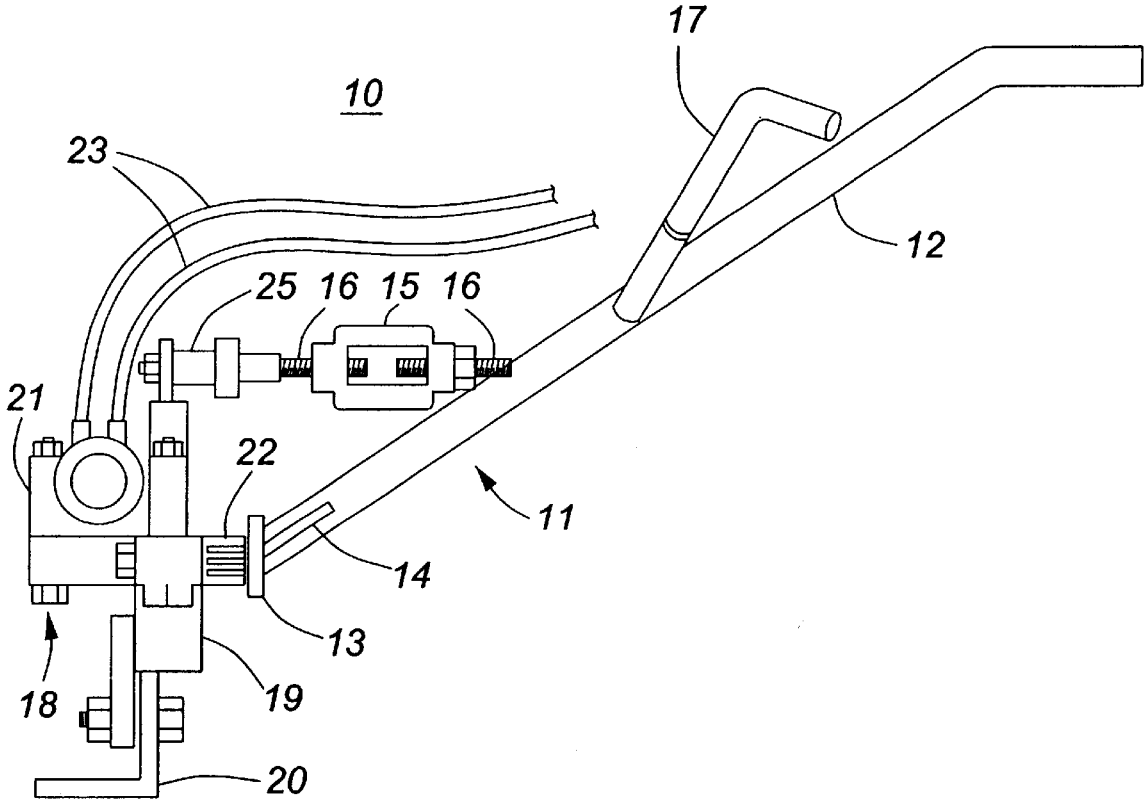
FIG. 3 is a side view of the screed unit.
Figure 4:
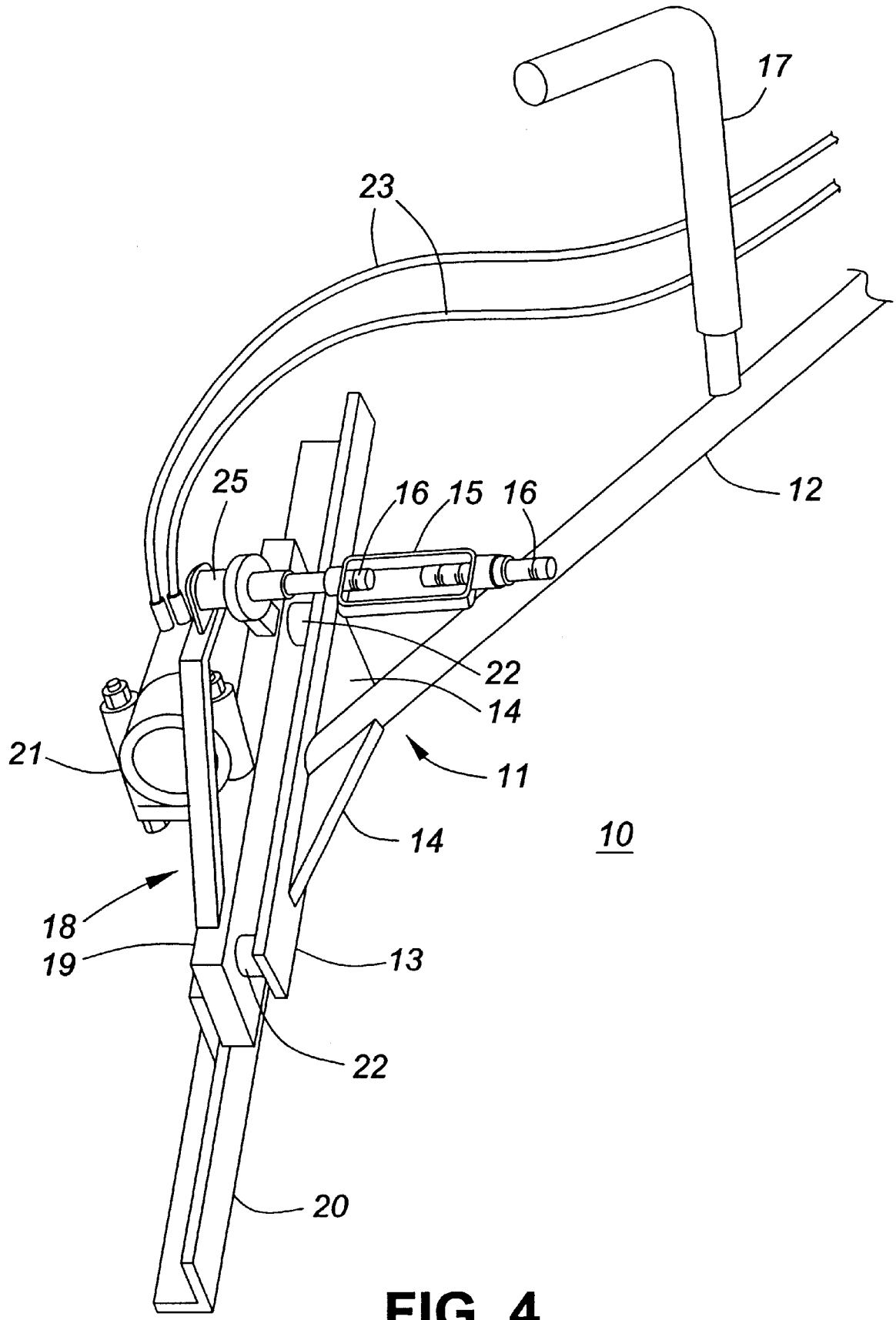
FIG. 4 is a perspective view of the screed unit.

Referring to the drawings, in FIG. 1 is shown a hydraulic powered screed 1 of the present invention in use by an operator 24. The hydraulic powered screed 1 consists of a vibrating screed 10 using a hydraulic vibrator 21 drawing hydraulic power from a separate power pack 2 worn by the operator 24. The vibrating screed 10 has a frame unit 18 connected to a handle unit 11 by three isolating mounts 22, 22, 25 as shown in FIGS. 2, 3 and 4.

The frame unit 18 comprises a frame 19 to which are mounted a screed blade 20 and a hydraulic vibrator 21, thereby connecting them to allow the transmitting of vibrations from the hydraulic vibrator 21 to the screed blade 20. The hydraulic vibrator 21 is preferably a Vibco model HLF-700.

The screed blades can be interchangeable. Any one of a number of different screed blades may be mounted. There are many different screed blades made by different manufacturers which would be suitable. One possible screed blade could be a length of 2" by 4" steel angle iron.

The handle unit 11 consists of a handle 12 and an auxiliary handle 17 to allow the operator to manipulate the vibrating screed. At the bottom end of the handle unit 11 is a cross bar 13 reinforced to the handle with gussets 14. The ends of the cross bar 13 provide mounting points for two isolating mounts 22, 22. These isolating mounts flexibly connect the cross bar to a lower part of the frame 19. A third mounting point for an isolating mount 25 is provided at the end of a turnbuckle assembly which is attached near the bottom end of the handle unit. This third mount connects the turnbuckle assembly of the handle unit to an upper part of the frame. These isolating mounts are preferably made of rubber or other flexible material to provide the function of isolating vibrations of the frame unit 18 from the handle unit 11. The flexibility of the isolating mounts also allow the two isolating mounts attached to the cross bar 13 to act as pivot points, allowing the frame unit to tilt relative to the handle unit when adjusted by the turnbuckle assembly 15. This allows the angle of the handle with respect to the screed blade to be adjusted to accommodate operators of different height and/or to adjust the pitch of the screed blade. This helps to reduce operator fatigue from trying to operate the unit in an uncomfortable position. Changing the pitch of the blade can change the quality of the finish of the concrete.

The power pack 2 comprises a hydraulic power pack 7 mounted on a backpack frame 3 which is worn by the operator 24. The hydraulic power pack 7 consists of an internal combustion engine 8 and a hydraulic pump 9. The hydraulic power pack 7 is preferably a Husqvarna model 250PS. The weight of the power pack 2 is transferred to the operator 24 via shoulder straps 4 and a waist belt 5. Padding 6 on the backpack frame 3 isolate any vibrations from the power pack to the operator.

Power is transmitted to hydraulic vibrator 21 by pressurized hydraulic fluid flowing through thin, flexible hydraulic hoses 23 from the hydraulic power pack 7 to the hydraulic vibrator 21. The hoses can be quickly disconnected to facilitate transportation and storage.

This invention has many advantages over the prior art. It only requires one operator. It is relatively lightweight and compact. The weight of the power pack is well distributed between the operator's hips and shoulders. The screed unit is lightweight, well balanced and easy to maneuver. It is independent of external power sources, thus enabling the operator to maneuver freely about a work site. This increases efficiency and safety. There are no dragging power cords or heavy hoses to snake around obstacles or to trip over. The vibrations of the screed unit are isolated from the power pack thus enhancing reliability and the vibrations of the screed unit are isolated from the operator thus reducing fatigue and thereby enhancing safety.

What is claimed is:

1. A portable vibrating screed system for compacting and smoothing cementitious materials and operable by a sole operator, comprising:

a vibrating screed unit having a hydraulic vibrator mounted to a frame, a screed blade mounted to a bottom side of said frame, and a handle mounted to said frame by a plurality of vibration damping units, the handle having an auxiliary handle to allow the operator to manipulate the screed blades; and a hydraulic power pack comprising a self contained rotary power source driving a hydraulic pump, said hydraulic power pack mounted on a back pack and wearable by said sole an operator, said hydraulic pump providing pressurized hydraulic fluid to said hydraulic vibrator via flexible hoses for causing said screed blade to vibrate as said vibrating screen unit is moved over the cementitious material by said operator.

2. The vibrating screed system of claim 1, wherein said self contained rotary power source is an internal combustion engine.

3. The vibrating screed system of claim 1, wherein said vibration damping units means comprises a rubber mount.

4. The vibrating screed system of claim 1, wherein at least one said vibration damping units pivotally connects said handle to said frame and at least one other said vibration damping units connects said handle to said frame via an adjustable turnbuckle assembly, thereby permitting adjustment of the angle of the handle.

5. The vibrating screed system of claim 4, wherein two said vibration damping units pivotally connect said handle to said frame and one other said vibration damping units connects said handle to said frame via said adjustable turnbuckle assembly.

6. A portable vibrating screed system for compacting and smoothing cementitious materials and operable by a sole operator, comprising:

a vibrating screed unit having a hydraulic vibrator mounted to a frame, an interchangeable screed blade mounted to a bottom side of said frame, and a handle mounted at an angle to said frame by three vibration damping mounts, the first two of said vibration damping mounts pivotally connecting said handle to said frame and the third of said vibration damping mounts connecting said handle to said frame via a turnbuckle assembly thereby permitting adjustment of said angle the handle having an auxiliary handle to allow the operator to manipulate the screed blade, and a hydraulic power pack comprising an internal combustion engine driving a hydraulic pump, said hydraulic power pack mounted on a backpack wearable by an operator, said hydraulic pump providing pressurized hydraulic fluid to said hydraulic vibrator means via flexible hoses for causing said screed blade to vibrate as said vibrating screed unit is moved over the cementitious material by said operator.

* * * * *